US012807353B2

(12) United States Patent
Caso

(10) Patent No.: US 12,807,353 B2
(45) Date of Patent: Nov. 24, 2026

(54) SYSTEM FOR CONDITIONING USED MATTRESSES

(71) Applicant: MONTALESE S.P.A., Agliana (IT)

(72) Inventor: Antonio Caso, Agliana (IT)

(73) Assignee: MONTALESE S.P.A., Agliana (IT)

( * ) Notice: Subject to any disclaimer, the term of this patent is extended or adjusted under 35 U.S.C. 154(b) by 0 days.

(21) Appl. No.: 18/993,336

(22) PCT Filed: May 15, 2023

(86) PCT No.: PCT/IB2023/054978
§ 371 (c)(1),
(2) Date: Jan. 10, 2025

(87) PCT Pub. No.: WO2024/023592
PCT Pub. Date: Feb. 1, 2024

(65) Prior Publication Data

US 2026/0021918 A1 Jan. 22, 2026

(30) Foreign Application Priority Data

Jul. 27, 2022 (IT) ..... 102022000015903

(51) Int. Cl.

| | |
|---|---|
| ***B65B 31/04*** | (2006.01) |
| ***B65B 5/04*** | (2006.01) |
| ***B65B 25/00*** | (2006.01) |
| ***B65B 55/24*** | (2006.01) |

(52) U.S. Cl.
CPC ..... *B65B 31/047* (2013.01); *B65B 5/045* (2013.01); *B65B 25/00* (2013.01); *B65B 55/24* (2013.01)

(58) Field of Classification Search
CPC ..... B65B 31/047; B65B 5/045; B65B 25/00; B65B 55/24; B65B 5/04; A61L 9/205; A47C 27/00; B65D 81/26; B65D 81/20
See application file for complete search history.

(56) References Cited

U.S. PATENT DOCUMENTS

| | | | | |
|---|---|---|---|---|
| 4,583,925 A * | 4/1986 | Hawkins | F04B 37/10 | 137/903 |
| 5,228,271 A * | 7/1993 | Wallace | B65D 81/2023 | 53/512 |
| 6,520,071 B1 * | 2/2003 | Lanza | B65B 31/047 | 141/96 |
| 7,096,893 B2 * | 8/2006 | Vilalta | B65D 51/1683 | 141/8 |

(Continued)

FOREIGN PATENT DOCUMENTS

WO 2021140454 A1 7/2021

OTHER PUBLICATIONS

International Search Report dated Aug. 21, 2023 from counterpart PCT App No. PCT/IB2023/054978.

(Continued)

*Primary Examiner* — Andrew M Tecco
*Assistant Examiner* — Nicholas E Igbokwe
(74) *Attorney, Agent, or Firm* — SHUTTLEWORTH & INGERSOLL, PLC; Timothy J. Klima

(57) ABSTRACT

Described is a transportable system for conditioning used mattresses, including a container made of floppy material designed to contain an air-tight mattress and including a suction valve, said system also comprising a suction device.

10 Claims, 4 Drawing Sheets

(56) References Cited

U.S. PATENT DOCUMENTS

| | | | | |
|---|---|---|---|---|
| 7,328,730 | B2 * | 2/2008 | Vilalta | B65D 51/1683 220/203.11 |
| 7,389,629 | B2 * | 6/2008 | Tretina | F04C 25/00 53/434 |
| 8,191,469 | B2 * | 6/2012 | Bergman | B65B 31/047 206/524.8 |
| 8,192,182 | B2 * | 6/2012 | LeBoeuf | F04B 33/00 417/555.1 |
| 8,240,112 | B2 * | 8/2012 | Binger | F04B 35/04 53/511 |
| 8,328,159 | B2 * | 12/2012 | Lee | F16K 3/243 383/44 |
| 8,740,591 | B2 * | 6/2014 | Blythe | F04B 29/00 417/555.1 |
| 10,683,115 | B2 * | 6/2020 | Chang | B65B 31/04 |
| 2008/0028730 | A1 * | 2/2008 | Savicki | F01C 13/00 53/85 |
| 2008/0279702 | A1 * | 11/2008 | Kim | B65B 31/02 417/413.1 |
| 2020/0198824 | A1 * | 6/2020 | Wu | B65B 57/18 |
| 2021/0025746 | A1 * | 1/2021 | Chin | B65B 31/04 |

OTHER PUBLICATIONS

Italian Search Report dated Apr. 6, 2023 from counterpart Italian App No. IT202200015903.

* cited by examiner

SYSTEM FOR CONDITIONING USED MATTRESSES

This application is the National Phase of International Application PCT/IB2023/054978 filed May 15, 2023 which designated the U.S.

This application claims priority to Italian Patent Application No. 102022000015903 filed Jul. 27, 2022, which application is incorporated by reference herein.

TECHNICAL FIELD

This invention relates to a transportable system for conditioning used mattresses.

In particular, the invention relates to a system for conditioning used mattresses which is able to allow a practical and hygienic transport of the mattresses.

BACKGROUND ART

There are prior art systems for packaging mattresses, both of the spring type and of the type with synthetic resin foams and others, which allow the reduction in the thickness of the mattress and the locking of the flattened arrangement of the mattress for dispatch.

There are currently prior art systems for conditioning mattresses according to which the mattress itself (but several mattresses could easily be stacked) is pressed in suitable presses in such a way as to reduce the height.

These prior art systems also comprise fixing means, such as, for example clips or belts, for blocking the mattress once it has reached the flattened condition.

If necessary, if an action of discharging the air is desired which is even more incisive, the prior art systems allow a suction operation at the same time as the pressing.

In this regard, the prior art provides a packaging for containing the mattress which is air-tight.

Whilst the methods described above are used in the packaging of new mattresses, there are not currently valid packaging methods for the used mattresses which are, for example, withdrawn at the time of purchasing and delivering the mattresses.

For the operators, as well as the practical difficulty of handling the used mattresses during their removal, especially double mattresses, due to their overall dimensions and weight, there is also a certain annoyance, or even danger in making contact with objects which are normally dirty and, even though they cannot be perceived with the naked eye, they are notoriously contaminated as they are full of mites, bacteria and other harmful elements such as fungi and moulds.

It is necessary to consider not only the individual mattress which has been used in a private-domestic environment but also the numerous mattresses, for example of a hotel or even a cruise ship which, at the moment of replacement may require, due to the large overall dimensions, a significant commitment in terms of labour and equipment.

In the latter case, given the large number of mattresses handled, there is a very high risk of the operators coming into contact with potentially hazardous elements such as mites and bacteria but also germs, fungi and mould since the mattress has not been used by a single user but by a plurality of users during their working life.

In short, one is dealing with ecological bombs during both their replacement and their subsequent storage in a waste disposal area.

An example of a known system is described in WO2021/140454 in the name of the same applicant.

AIM OF THE INVENTION

Aim of the invention is to provide a transportable system for conditioning used mattresses which allows the above-mentioned issues of the prior art to be overcome and is at the same time effective, practical to use and inexpensive to make.

Yet another aim of the invention is to provide a system for conditioning mattresses which is easily transportable and of limited dimensions.

According to the invention, these aims and others are achieved by a system for conditioning used mattresses comprising the technical features described in the accompanying claims.

BRIEF DESCRIPTION OF THE DRAWINGS

The technical features of the invention, according to the above-mentioned aims, are clearly described in the appended claims and its advantages are apparent from the detailed description which follows, with reference to the accompanying drawings which illustrate non-limiting example embodiments of it, and in which:

DETAILED DESCRIPTION

With reference to the accompanying drawings, the numeral 1 denotes in its entirety a transportable system for conditioning used mattresses made in accordance with the invention, hereinafter also referred to simply as the system 1.

Figure 1:
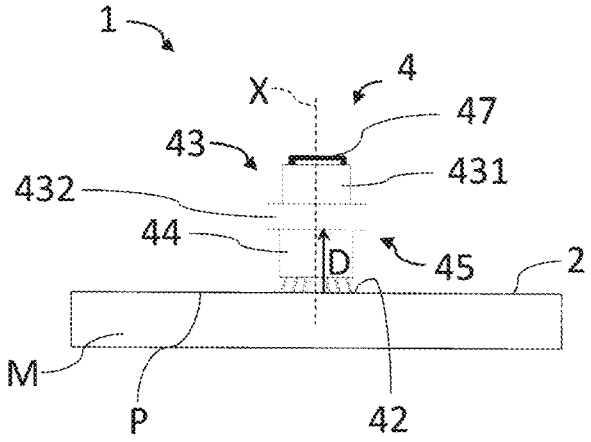
FIG. 1 shows a schematic side view of a transportable system for conditioning used mattresses according to the invention.
Figure 2:
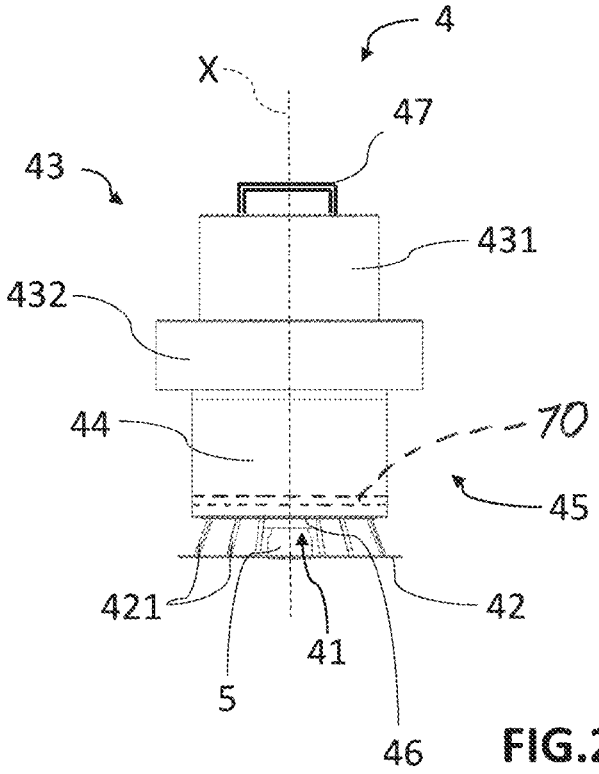
FIG. 2 shows a schematic side view of a detail of the system of FIG. 1.
Figure 3:
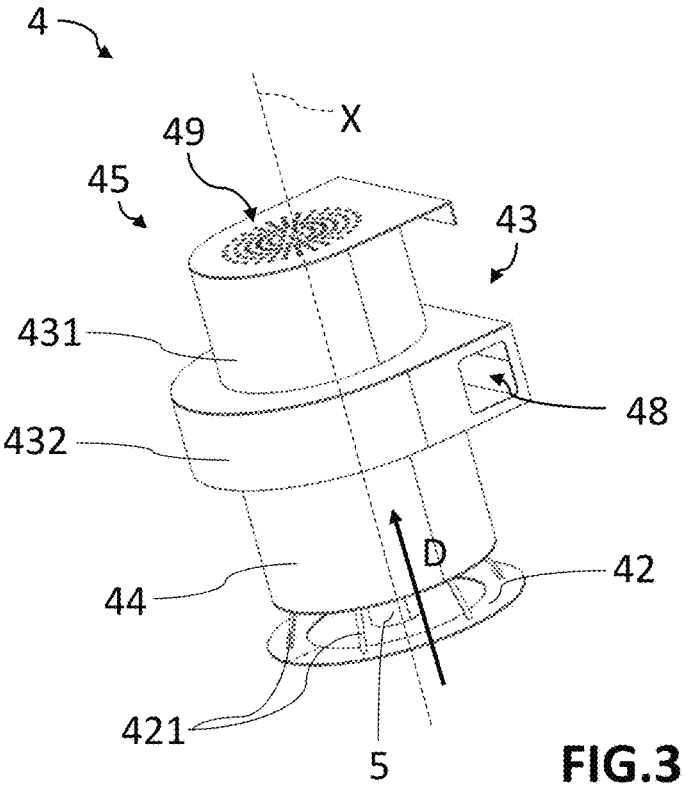
FIG. 3 shows a schematic perspective view from above of the detail of FIG. 2.
Figure 4:
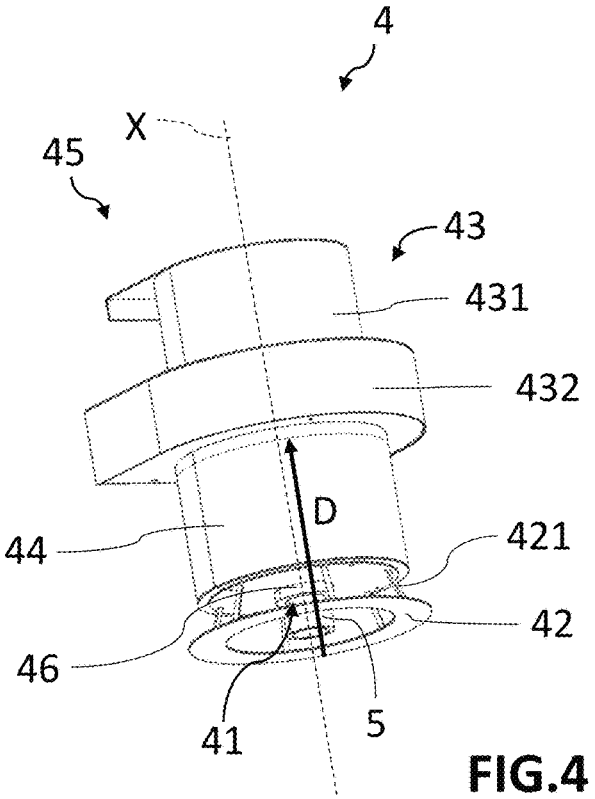
FIG. 4 shows a schematic perspective view from below of the detail of FIG. 2.

With reference to FIG. 1, the system 1 according to the invention comprises a container 2 made of floppy material designed to contain an air-tight mattress M.

Figure 5:
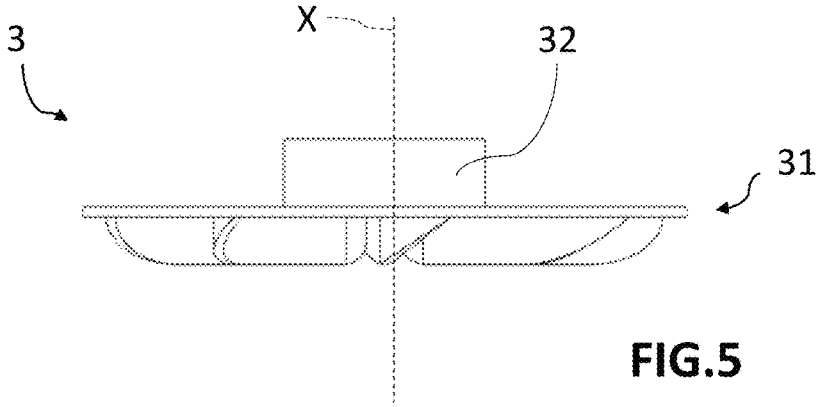
FIG. 5 shows a schematic side view of a further detail of the system of FIG. 1.
Figure 6:
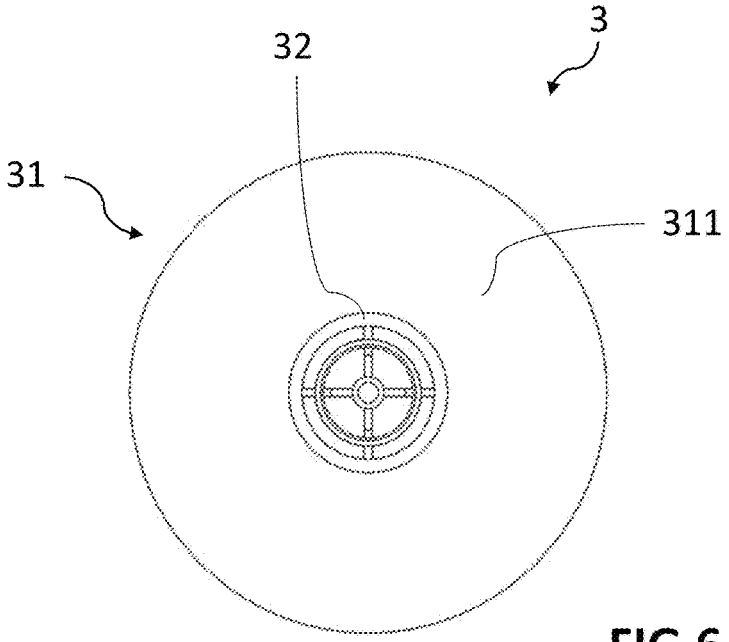
FIG. 6 shows a schematic view from above of the detail of FIG. 5.
Figure 7:
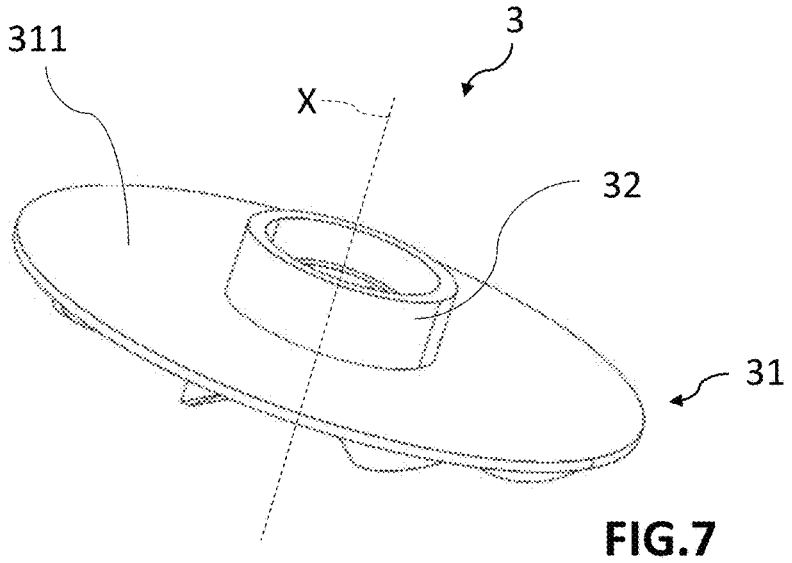
FIG. 7 shows a schematic perspective view from above of the detail of FIG. 5.

The container 2 also comprises a suction valve 3, illustrated in a relative embodiment in FIGS. 5 to 7.

Advantageously, the suction valve 3 comprises a disc-shaped portion 31 designed to adhere to an inner surface of the container 2 made of floppy material and a connecting portion 32 designed to emerge externally from the container 2.

Advantageously, also, the disc-shaped portion 31 has a double-sided adhesive layer 311.

The double-sided adhesive layer 311 allows an optimum adhesion of the valve 3 to the inner surface of the container 2, so as to guarantee an optimum suction.

This type of adhesion (unlike, for example, what occurs with the prior art heat-sealed valves) also allows the use of a valve 3 which can be reused for conditioning various mattresses, simply by changing the adhesive layer.

Advantageously, the connecting portion 32 is smooth.

Alternatively, the connecting portion 32 has a thread.

With reference to FIGS. 1 to 4, the system 1 according to the invention also comprises a suction device 4 having a main axis of extension X.

In use, the main axis of extension X is transversal (substantially perpendicular) to a plane identified by a wall P of the mattress M on which the device 4 is positioned.

The device 4 comprises a suction port 41 shaped to match the valve 3 of the container 2 made of floppy material.

The device 4 also comprises a support base 42 designed to keep the suction device 4 in stable equilibrium on the mattress M when the suction port 41 is connected to the valve 3.

Advantageously, the support base 42 is circular in shape.

According to a further embodiment, the support base 42 has a polygonal shape.

The device 4 also comprises air suction means 43 designed to be put in fluid communication with the container 2 made of floppy material, through the above-mentioned suction port 41 and the valve 3, to suck the air present in the mattress M contained in the container 2 made of floppy material.

The air suction means 43 are designed to suck air along a single direction D parallel to the main axis of extension X of the device 4.

The air suction means 43 comprise a motor 431.

Advantageously, the motor 431 is powered by a battery.

The air suction means 43 also comprise a fan 432 driven by the motor 431 and designed to suck air from the container 2 made of floppy material.

The suction device 4 comprises a photocatalytic filtering organ 44 for filtering the air sucked by the air suction means 43.

Advantageously, the device 4 comprises a light source (not illustrated) configured to irradiate the photocatalytic filtering organ 44 with a light radiation designed to allow the photocatalytic filtering organ 44 to degrade and oxidise pollutant compounds and/or bacteria present in the sucked air.

Advantageously, also, the photocatalytic filtering organ 44 comprises a plurality of filtering partitions arranged in series and spaced by respective light sources.

The filtering partitions are advantageously in the shape of a honeycomb made of ceramic or plastic material.

The light sources are advantageously of the UV type with an emission frequency determined according to the type of photocatalytic filter used.

Advantageously, the device 4 comprises a secondary filter 70, interposed between the valve 3 and the photocatalytic filtering organ 44 and configured to retain residues and impurities and prevent them from entering into contact with the filtering organ 44.

In this regard, the secondary filter 70 is located upstream of the photocatalytic filtering organ 44 with respect to the suction direction D (that is, the direction of travel of the air sucked).

In short, the air sucked from the container 2, through the valve 3, passes through the suction port 41 entering the device 4 and subsequently through the photocatalytic filtering organ 44, meeting firstly the secondary filter 70.

Downstream of the photocatalytic filtering organ 44 the air, now filtered and purified, exits from an outlet opening 48 to disperse into the surrounding environment.

The device 4 also comprises a containment body 45 for containing the photocatalytic filtering organ 44 and the suction means 43.

The valve 3, the suction port 41, the support base 42, the photocatalytic filtering organ 44 and the suction means 43 are aligned on the main axis of extension X of the device 4.

Advantageously, the support base 42 has a diameter larger than the diameter of the filtering organ 44.

This allows an increase in the stability of the suction device 4 to keep it in equilibrium even during use.

During use, that is to say, during a suction step, it is in effect normal that the support base (defined by the portion of mattress M on which the suction device 4 rests) is not completely flat, but has creases and dips which in the absence of the stable support base 42 could adversely affect the equilibrium of the suction device 4.

Advantageously, the support base 42 is connected to the containment body 45 by a plurality of support columns 421.

The suction device 4 advantageously comprises a tubular conduit 46 extending along the axis X.

Advantageously, the conduit 46 is made of rigid material and is interposed between the suction valve 3 and the filtering organ 44.

Alternatively, it is interposed between the suction valve 3 and the secondary filter.

Advantageously, moreover, the suction port 41 is made on a lower end of the tubular conduit 46.

The system 1 according to the invention advantageously comprises a connecting element 5 configured to be interposed in a removable fashion between the above-mentioned suction port 41 and the valve 3.

Figure 8A:
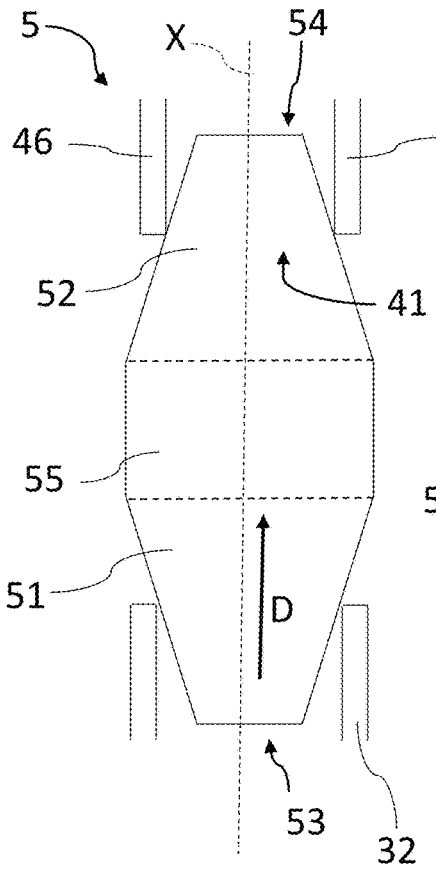
FIG. 8*a* shows a lateral cross section view of a first embodiment of a detail of the system of FIG. 1.

Moreover, advantageously, with reference to FIG. 8*a*, the connecting element 5 has a first portion 51 with a transversal cross section diametrically increasing along the axis X (in particular along the suction direction D) and designed to engage inside the connecting portion 32 of the suction valve 3, and a second portion 52 with a transversal cross section diametrically decreasing along the axis X (in particular along the suction direction D) designed to engage inside the suction port 41.

The connecting element 5 has an inlet opening 53 made on a lower end of the first portion 51 and an outlet opening 54 made on an upper end of the second portion 52.

The first portion 51 with a transversal cross-section diametrically increasing along the axis X defines a first conical portion with a trapezoidal longitudinal cross-section.

The second portion 52 with a transversal cross-section diametrically decreasing along the axis X defines a second conical portion with a trapezoidal longitudinal cross-section.

More specifically, the first conical portion 51 with a trapezoidal longitudinal cross-section and the second conical portion 52 with a trapezoidal longitudinal cross-section have a specular extension with respect to a central cylindrical portion 55.

Figure 8B:
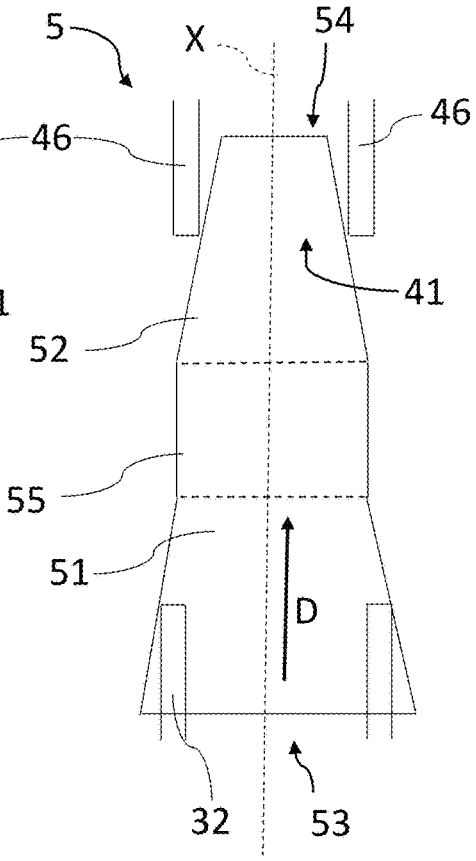
FIG. 8*b* shows a lateral cross section view of a second embodiment of a detail of the system of FIG. 1.

According to a second embodiment shown in FIG. 8*b*, the connecting element 5 has a first portion 51 with a transversal cross section diametrically decreasing along the axis X (in particular along the suction direction D) configured in such a way that the connecting portion 32 of the suction valve 3 is designed to engage inside the first portion 51, and a second portion 52 with a transversal cross section diametrically decreasing along the axis X (in particular along the suction direction D) designed to engage inside the suction port 41.

Figure 9:
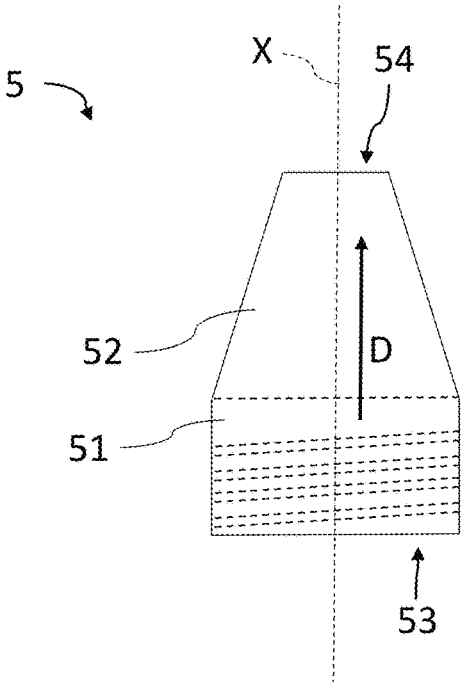
FIG. 9 shows a lateral cross section view of a third embodiment of the detail of FIGS. 8*a* and 8*b*.

According to a third embodiment, shown in FIG. 9, the connecting element 5 has a first threaded portion 51 with a cylindrical longitudinal cross-section designed to engage by screwing/unscrewing with a thread of the connecting portion 32 of the valve, and a second portion 52 with a transversal cross-section diametrically decreasing along the axis X (in particular along the direction D of suction) designed to engage inside the suction port 41.

According to the embodiments indicated, the presence of the connecting element 5 allows the speed of fitting/removal of the device 4 on the container 2 made of floppy material to be optimised.

In this way, the actions of fitting and removing the system 1 are decidedly facilitated with respect to what would occur if the entire device 4 had be unscrewed/screwed with the valve 3.

According to another embodiment, not illustrated, the tubular conduit 46 of the device 4 has a conical portion designed to engage inside the connecting portion 32 of the valve 3.

Moreover, advantageously, the suction device 4 comprises a gripping element 47 positioned on an outer surface of the containment body 45.

The device 4 also comprises an outlet opening 48 for expelling the sucked air after the air has passed through the secondary filter and the photocatalytic filtering organ 44.

Advantageously, the device 4 comprises a plurality 49 of holes for cooling the motor 431 made on a wall of the containment body 45.

In use, the system 1 according to the invention comprises a first step of preparing the container 2 made of floppy material designed to contain the air-tight mattress M.

A hole is made on an inner wall of the container 2 designed to allow the passage of the connecting portion 32 of the valve 3, whilst the disc portion 31 is made to adhere to the container 2 by means of the adhesive layer 311.

Advantageously, the connecting element 5 is provided between the portion 32 of the valve 3 and the suction port 41.

As described above, preparing the connecting element 5 allows the speed of fitting/removal of the device 4 on the container 2 made of floppy material to be optimised.

In this way, the actions of fitting and removing the system 1 are decidedly facilitated with respect to what would occur if the entire device 4 had be unscrewed/screwed with the valve 3.

The device 4 is then prepared in such a way as to stably connect the suction port 41 to the connecting element 5 in such a way that the device 4, the connecting element 5 and the valve 3 are aligned along the main axis of extension X.

Alternatively, the suction port 41 is stably connected directly to the valve 3.

This is followed by the step of sucking, along a single direction D, the air present inside the container 2 made of floppy material using the air suction means 43.

This is followed by the step of filtering the air sucked from the container 2 made of floppy material using the photocatalytic filtering organ 44.

The invention overcomes the drawbacks of the prior art and brings important advantages.

A first advantage consists in the fact of providing a transportable system for conditioning used mattresses which is easy and practical to use.

A further advantage of the transportable system for conditioning used mattresses according to the invention is due to the overall size optimised relative to the prior art systems, and the lightness of the system 1.

These features allow an easy handling and a convenient use in any situation.

Moreover, the transportable system for conditioning used mattresses according to the invention combines with a practical and convenient use also an optimum suction effectiveness such as to guarantee the safety of the operators in terms of protection against any bacteria, fungi or moulds present in the used mattress before the suction.

The invention claimed is:

1. A transportable system to condition used mattresses, comprising:

a container made of a floppy material configured to airtightly contain a mattress, said container comprising a suction valve;

a suction device having a main longitudinal axis, said suction device comprising:

a suction port counter-shaped to said valve of said container, a support base configured to keep said suction device stably balanced on said mattress when said suction port is connected to said valve, an air suction device configured to be placed in fluid connection with said container made of floppy material, through said suction port and said valve, to suck air present in the mattress contained in said container made of floppy material, said air suction device being configured to suck air along a single direction parallel to said main longitudinal axis;

a photocatalytic filtering organ to filter the air sucked in by said air suction device;

a containment body to contain said photocatalytic filtering organ and said air suction device;

said suction port, said support base, said air suction device, said photocatalytic filtering organ and said valve being arranged aligned on said main longitudinal axis;

wherein said support base has a diameter greater than a diameter of said photocatalytic filtering organ.

2. The system according to claim 1, wherein said suction device comprises a tubular conduit extending along said main longitudinal axis, said tubular conduit being made of a rigid material and being interposed between said suction valve and said photocatalytic filtering organ.

3. The system according to claim 1, wherein said suction valve comprises a portion conformed to a disc configured to adhere on an inner surface of said container made of a floppy material and a connecting portion configured to emerge externally from said container.

4. The system according to claim 3, wherein said portion conformed to a disc has double-sided adhesive layer.

5. The system according to claim 3, wherein said connecting element has a first cross-sectional portion diametrically increasing along said main longitudinal axis and adapted to engage internally with said connecting portion of said suction valve, and a second cross-sectional portion diametrically decreasing along said main longitudinal axis adapted to engage internally with said suction port.

6. The system according to claim 3, wherein said connecting element has a first diametrically decreasing cross-sectional portion along said main longitudinal axis configured so that said connecting portion of said suction valve is configured to engage internally with said first portion, and a second diametrically decreasing cross-sectional portion along said main longitudinal axis configured to engage internally with said suction port.

7. The system according to claim 3, wherein said connecting element has a first threaded portion having a cylindrical longitudinal cross-section configured to engage in screwing/unscrewing with a thread of said connecting portion of said valve, and a second portion having a diametrically decreasing cross-section along said main longitudinal axis configured to engage internally with said suction port.

8. The system according to claim 1, and further comprising a secondary filter interposed between said valve and said photocatalytic filtering organ configured to retain residues and impurities and prevent the residues and impurities from coming into contact with said photocatalytic filtering organ.

9. The system according to claim 1, and further comprising a connecting element configured to be removably interposed between said suction port and said valve.

10. The system according to claim 1, wherein said suction device comprises a gripping element disposed on an outer surface of said containment body.

* * * * *